US012692849B2

(12) United States Patent
Mueller et al.

(10) Patent No.: US 12,692,849 B2
(45) Date of Patent: Jul. 28, 2026

(54) RADIAL PISTON COMPRESSOR WITH TRANSMISSION ELEMENT AND PISTON GUIDE RING

(71) Applicants: thyssenkrupp Dynamic Components GmbH, Ilsenburg (DE); thyssenkrupp AG, Essen (DE)

(72) Inventors: Ulf Mueller, Chemnitz (DE); Uwe Dietel, Lichtentanne (DE); Sebastian Krause, Magdeburg (DE); Robert Reichelt, Niederwiesa (DE)

(73) Assignees: thyssenkrupp Dynamic Components GmbH, Ilsenburg (DE); thyssenkrupp AG, Essen (DE)

( * ) Notice: Subject to any disclaimer, the term of this patent is extended or adjusted under 35 U.S.C. 154(b) by 0 days.

(21) Appl. No.: 19/039,581

(22) Filed: Jan. 28, 2025

(65) Prior Publication Data

US 2025/0172133 A1 May 29, 2025

Related U.S. Application Data

(63) Continuation of application No. 18/026,957, filed as application No. PCT/EP2021/075257 on Sep. 14, 2021, now Pat. No. 12,286,965.

(30) Foreign Application Priority Data

Sep. 17, 2020 (DE) ..... 10 2020 211 680.6

(51) Int. Cl.

| | |
|---|---|
| ***F04B 27/04*** | (2006.01) |
| ***F04B 9/04*** | (2006.01) |
| ***F04B 27/053*** | (2006.01) |

(52) U.S. Cl.
CPC ..... *F04B 27/0414* (2013.01); *F04B 9/04* (2013.01); *F04B 27/053* (2013.01)

(58) Field of Classification Search
CPC .... F04B 27/0414; F04B 27/0531; F04B 9/04; F04B 9/047
See application file for complete search history.

(56) References Cited

U.S. PATENT DOCUMENTS 2,818,816 A * 1/1958 Christenson ..... F04B 53/1075 417/490
3,828,653 A 8/1974 Knodel et al.
(Continued)

FOREIGN PATENT DOCUMENTS

DE 11 74 591 B 7/1964
DE 196 26 938 A1 1/1998
(Continued)

OTHER PUBLICATIONS

English Translation of International Search Report issued in PCT/EP2021/075257, dated Dec. 22, 2021.

*Primary Examiner* — Nathan C Zollinger
(74) *Attorney, Agent, or Firm* — hyssenkrupp North America, LLC

(57) ABSTRACT

The present invention relates to a piston-cylinder assembly for a radial piston compressor. The piston-cylinder assembly comprises a drive shaft with a cylindrical eccentric for guiding the movement of the piston to a top dead center position. A cylindrical piston guide ring guides the movement of the piston to a bottom dead center. Both the cylindrical eccentric and the piston guide ring are connected to the piston by means of respective concave/convex contact surfaces for the positive transmission of the forces.

9 Claims, 8 Drawing Sheets

(56) References Cited

U.S. PATENT DOCUMENTS

| | | | | |
|---|---|---|---|---|
| 5,280,745 | A | 1/1994 | Maruno | |
| 5,634,777 | A * | 6/1997 | Albertin | F04B 1/0421 74/570.21 |
| 12,286,965 | B2 * | 4/2025 | Mueller | F04B 27/053 |
| 2005/0120984 | A1 | 6/2005 | Kuhn | |
| 2012/0111185 | A1 * | 5/2012 | Stephenson | F04B 1/0421 91/491 |
| 2014/0322050 | A1 * | 10/2014 | Marette | F04B 49/22 417/437 |
| 2015/0044072 | A1 * | 2/2015 | Gorlich | F04B 27/0414 417/419 |
| 2015/0300337 | A1 | 10/2015 | Göerlich | |
| 2024/0240627 | A1 * | 7/2024 | Mueller | F04B 1/0421 |

FOREIGN PATENT DOCUMENTS

| | | | | |
|---|---|---|---|---|
| DE | 103 56 373 | A1 | 7/2005 | |
| DE | 10 2005 025 869 | A1 | 12/2006 | |
| DE | 10 2006 059 600 | A1 | 6/2008 | |
| DE | 10 2008 017 535 | B3 | 8/2009 | |
| DE | 10 2012 005 297 | A1 | 9/2013 | |
| EP | 1 553 291 | A2 | 7/2005 | |
| EP | 3 075 950 | A1 | 10/2016 | |
| GB | 577423 | A | 5/1946 | |
| GB | 580320 | A | 9/1946 | |
| GB | 627065 | A | 7/1949 | |
| GB | 685672 | A * | 1/1953 | F04B 1/0426 |
| JP | S58 176484 | A | 10/1983 | |
| WO | 2011/117904 | A1 | 9/2011 | |
| WO | 2014/087201 | A1 | 6/2014 | |

* cited by examiner

RADIAL PISTON COMPRESSOR WITH TRANSMISSION ELEMENT AND PISTON GUIDE RING

CROSS REFERENCE TO RELATED APPLICATIONS

This application is a continuation application of U.S. patent application Ser. No. 18/026,957, filed Mar. 17, 2023, which is a U.S. National Stage Entry of International Patent Application Serial Number PCT/EP2021/075257, filed Sep. 14, 2021, which claims priority to German Patent Application No. DE 10 2020 211 680.6, filed Sep. 17, 2020, the entire contents of which are incorporated herein by reference.

FIELD

The present disclosure generally relates to a piston-cylinder assembly for a radial piston compressor.

BACKGROUND

Document EP 1 553 291 A2 is concerned with a reciprocating piston machine which is intended to be suitable as a compressor of a $CO_2$-vehicle air conditioning system. The reciprocating piston machine has radially directed piston-cylinder units, which are arranged distributed uniformly over the circumference, and an eccentric shaft. The eccentric shaft extends through a housing body enclosing the cylinders and uses its eccentric to control the stroke of the pistons, i.e. the radially outwardly directed compression movement of the piston in the direction of the top dead center of the piston movement. The return movement of the pistons is controlled by a common control ring engaging in a recess of the pistons (cf., in particular, FIG. 3 of EP 1 553 291 A2). It is disadvantageous that the control ring is in controlling sliding contact with the piston via an inner control surface. This sliding contact can lead to wear and component failure. It is moreover disadvantageous that the piston body has, at its end facing the eccentric, a plane contact surface (the "inner end surface 15") with which the piston is in direct contact with the outer ring of a rolling contact bearing which is arranged on the eccentric. The piston body is therefore exposed to high loads. The continuous changing of the contact surface between piston and bearing outer ring also occurs.

Document DE 10 2012 005 297 A1 discloses a piston-cylinder assembly for a radial piston compressor which is intended to be suitable for compressing the refrigerant $CO_2$ (refrigerant R744). The stroke movement of the pistons arranged distributed uniformly in the circumferential direction in cylinder bores is generated via an eccentric which is arranged on a drive shaft. The eccentric has a rolling contact bearing with a bearing outer ring. A transmission element which is in the form of a connecting rod is supported via a concavely shaped supporting surface on the outer shell surface of the bearing outer ring. At that end of the connecting rod which is spaced apart from the supporting surface a connecting rod eye is provided via which the connecting rod is connected in an articulated manner to the piston by means of a piston pin. The piston therefore has a receiving bore for the piston pin.

The disadvantage of the piston-cylinder assembly known from DE 10 2012 005 297 A1 is that the high forces occurring within the scope of the stroke movement/compression movement of the piston in the direction of the top dead center (TDC) and the forces occurring within the scope of the suction movement of the piston in the direction of the bottom dead center (BDC) act via the piston pin on the connecting rod and on the piston. In particular in the case of the radial piston compressors for the refrigerant $CO_2$, in which high pressures and therefore large forces and surface pressures occur, the piston pin and the receiving regions for the piston pin on the connecting rod constitute component regions which are subjected to a critical load. Specifically in the case of radial piston compressors of small dimensions, e.g. for air conditioning systems for motor vehicles, the pistons have small diameters and the piston pins can likewise have only small diameters. Due to the high loads to which piston-cylinder assemblies of radial piston compressors for the refrigerant $CO_2$ are exposed, in the case of the design known from DE 10 2012 005 297 A1 very high surface pressures occur, in particular in the connecting region of the piston pin/connecting rod eye. There is therefore the risk of wear and premature component failure of the piston pin and/or of the connecting rod in the region of the connecting rod eye.

The piston itself is also exposed to high surface pressures because of the high loads occurring in the region of the receiving bore of the piston pin. Therefore, wear and premature component failure can also occur in the case of the piston. A further disadvantage is that the receiving bore for the piston pin mechanically weakens the piston.

Moreover, a disadvantage in the case of the piston-cylinder assembly known from document DE 10 2012 005 297 A1 is that the connecting rod takes up a large amount of construction space and has a relatively complex shape. The connecting rod extends in the radial direction over a large length, and, at its end facing the piston, it has connecting rod eyes and, at its end facing the eccentric, it has operative surfaces which interact with cross-sectionally L-shaped control rings. The return movement is transmitted to the piston via the control rings.

Thus a need exists for a piston-cylinder assembly which is robust and at the same time compact, i.e. takes up little construction space. The intention is that no mechanical weakening of the piston occurs and relatively small surface pressures occur even at high compression pressures. The present disclosure provides a robust radial piston compressor which is suitable for the high pressures and large forces occurring during the compression of the refrigerant $CO_2$.

DETAILED DESCRIPTION

Figure 1:
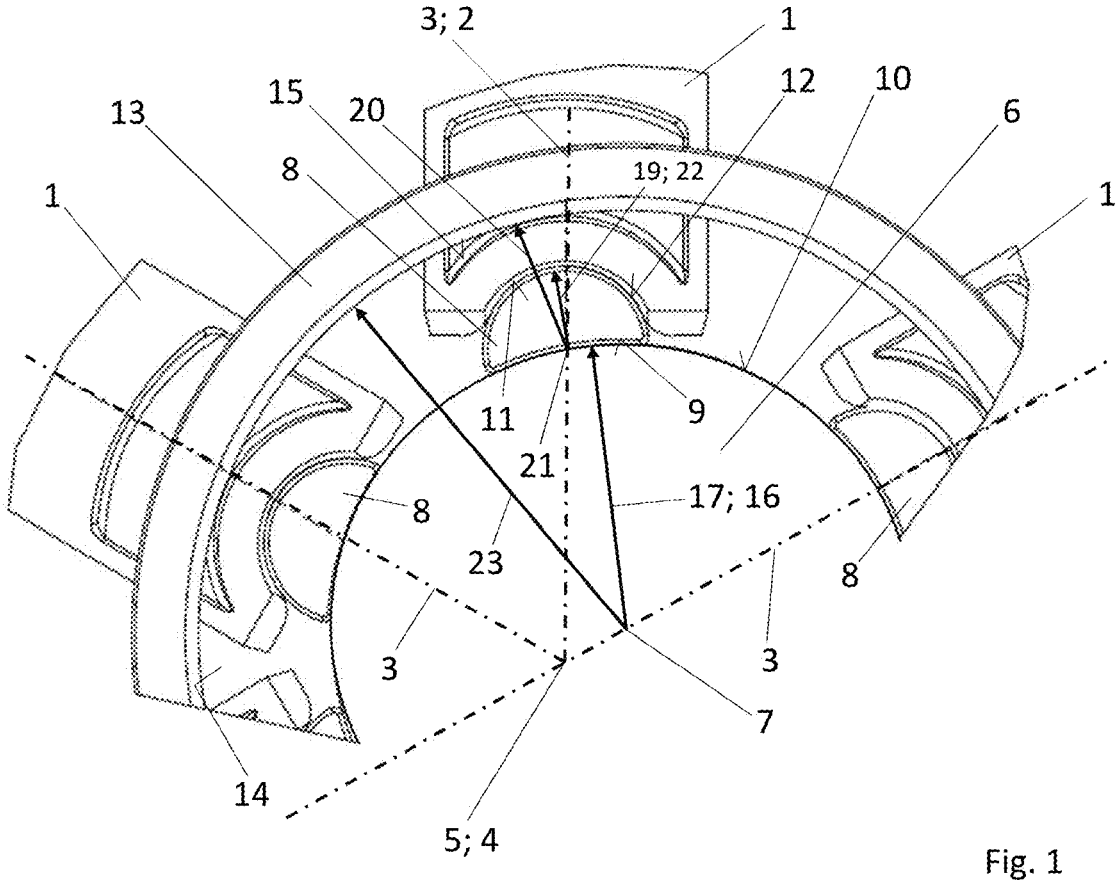
FIG. 1 is a radial half sectional view of a first embodiment of a piston-cylinder assembly according to the invention.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The invention relates to a piston-cylinder assembly for a radial piston compressor. The radial piston compressor can have a plurality of piston-cylinder assemblies arranged and distributed uniformly in a circumferential direction. In particular, the invention relates to a piston-cylinder assembly for a radial piston compressor which is used for compressing refrigerant, with $CO_2$ (refrigerant R744) being used as the refrigerant. The refrigerant is compressed in the high-pressure range to pressures of 140 bar or higher, and therefore high mechanical loadings of the piston-cylinder assembly occur.

The piston-cylinder assembly according to the invention for a radial piston compressor comprises a piston; a cylinder bore, in which the piston is arranged displaceably along a center line of the cylinder bore; a drive shaft with an axis of rotation and with a cylindrical eccentric, the center point of which is spaced apart from the axis of rotation of the drive shaft, wherein, during a rotational movement of the drive shaft, the piston is movable by the cylindrical eccentric in the cylinder bore in a manner directed outward in the radial direction away from the drive shaft as far as a top dead center (TDC); and a transmission element, which transmits the movement of the eccentric to the piston for generating the movement of the piston outward in the cylinder bore in a manner directed away from the drive shaft, wherein the transmission element has a first supporting surface with which the transmission element is supported on a cylinder surface of the eccentric.

According to the invention, the piston has a concavely shaped, first operative surface facing the transmission element, and the transmission element has a convexly shaped, second supporting surface facing the first operative surface, wherein the first operative surface and the second supporting surface form a form-fitting connection which is effective in the circumferential direction of the eccentric, and a cylindrical piston guide ring is provided, through which the piston is movable in the cylinder bore in a manner directed inward toward the drive shaft in the radial direction from the top dead center (TDC) as far as a bottom dead center (BDC), wherein the piston has a convexly shaped, second operative surface which faces an inner shell surface of the piston guide ring and which, together with the inner shell surface of the piston guide ring, forms a form-fitting connection which is effective in the direction of the center line of the cylinder bore.

Within the scope of the invention, the stroke movement of the piston is therefore transmitted by the eccentric via the first supporting surface to the transmission element, and the transmission element transmits the stroke movement via the convexly shaped, second supporting surface of the transmission element and the concavely shaped, first operative surface of the piston to the piston. At the same time, a convexly shaped, second operative surface is formed on the piston and is operatively connected to the inner shell surface of the piston guide ring. The piston guide ring brings about the return movement of the piston from the top dead center TDC to the bottom dead center BDC.

In the case of the piston-cylinder assembly according to the invention, the surface pressure which occurs at the contact surface between the convex second supporting surface of the transmission element and the concave first operative surface of the piston is substantially smaller, even at high compression pressures, than the surface pressures which occur in the case of the design known from document DE 10 2012 005 297 A1 in the region of the piston pin, the connecting rod eye and the receiving bore for the piston pin in the piston body. The contact surface between the convex second supporting surface of the transmission element and the concave first operative surface of the piston is of such a large size, because of the shape of the two surfaces, that, even at the high compression pressures which occur in radial piston compressors for the refrigerant $CO_2$, the surface pressures do not reach critical values. Premature wear of the components is therefore avoided and the components achieve the required service life.

In the case of the design according to the invention, the transmission element can be very compact, and therefore it takes up only a small amount of construction space because the transmission element is not connected to the piston and it is not necessary to form operative surfaces on the transmission element which interact with a control ring via which the return movement is transmitted to the pistons. This is because, in order to transmit the return movement to the piston, according to the invention the piston guide ring with its inner shell surface acts directly on the piston via the second operative surface, which is formed on the piston body. The transmission element can therefore be very compact and, both in respect of its shaping and in respect of its choice of material, can be specifically adapted to its task of transmitting the stroke movement for the compression stroke to the piston and at the same time of taking up as little construction space as possible. During the compression stroke, the greatest mechanical loads occur during a working cycle of the piston. It is therefore advantageous that the design according to the invention makes it possible to design the transmission element such that it is optimally adapted to the task of transmitting the compression stroke movement.

The first supporting surface of the transmission element can be designed as a flat surface, e.g. as a flat surface in the form of a circular disk. In this case, the flat surface interacts with the cylindrical shell surface of the eccentric or with a cylindrical outer ring of a rolling contact bearing arranged on the shell surface of the eccentric.

According to one embodiment of the invention, the first supporting surface of the transmission element is a flat surface or a concavely shaped cylinder shell section with a first supporting surface radius, the first supporting surface radius corresponding to the radius of the cylinder shell surface of the eccentric. If the first supporting surface is designed as a flat surface, there is linear contact between the first operative surface and the cylinder shell surface of the eccentric. If the first supporting surface of the transmission element is designed as a concavely shaped cylinder shell section, a larger contact surface is achieved between eccentric and transmission element in comparison to an embodiment with a flat first supporting surface, which leads at a given mechanical load to smaller surface pressures.

According to one embodiment of the invention, it is provided that the second supporting surface of the transmission element is a cylinder shell section with a second supporting surface radius, and the first operative surface of the piston is a cylinder shell section with a first operative surface radius, or wherein the second supporting surface of the transmission element is a spherical surface section with a second supporting surface radius, and the first operative surface of the piston is a ball socket with a first operative surface radius, with the second supporting surface radius and the first operative surface radius being identical in size.

If the second supporting surface of the transmission element and the first operative surface of the piston are designed as cylinder shell sections with the same radius, the piston is then secured against rotation about its longitudinal axis. Such a securing of the piston against rotation may be expedient and advantageous if a constant angular position of the piston relative to the cylinder bore and the housing in which the cylinder bore is arranged is of interest. For example, the piston can have a piston valve which has to interact with an inflow channel, which is arranged in the housing and is intended for the fluid to be compressed.

In order to prevent the transmission element, which is designed as the cylinder shell section, from migrating in the axial direction, there has to be axial securing. Such axial securing can be formed, for example, by thrust surfaces protruding in the radial direction and/or by thrust rings, snap rings or similar elements inserted into grooves of the piston body or of the housing.

If the second supporting surface of the transmission element is designed as a spherical surface section and the first operative surface of the piston as a ball socket with the same radius, the piston can then rotate about its longitudinal axis. However, it does not have to be secured against migrating in the axial direction because the spherical-cap-shaped contact surface between transmission element and piston keeps the transmission element in place in the axial direction. The transmission element is automatically secured/centered axially with respect to the axis of the piston by the spherical surface section and the ball socket. Additional axial securing of the transmission element is then not required.

According to one embodiment of the invention, it is provided that the second operative surface of the piston is a cylinder shell section with a second operative surface radius, wherein the second supporting surface radius of the transmission element and the second operative surface radius of the piston have the same center point, wherein the center point on the cylindrical surface of the eccentric is the point at which the center line of the cylinder bore penetrates the cylindrical surface of the eccentric, and wherein the sum of the radius of the eccentric and the second operative surface radius of the piston corresponds to the radius of the inner shell surface of the piston guide ring. The effect achieved by this is that the piston guide ring, which is in the form of a circular ring, with its inner shell surface never, i.e. not in any angular position of the eccentric, loses contact with the second operative surface of the piston. The piston guide ring is thereby always in contact (without losing contact) with the respective piston. Additional contact changes and sliding displacement movements between the piston guide ring and piston are therefore avoided, and this has dynamic advantages and advantages in terms of wear. Acoustic advantages are thereby also achieved because no rattling noises arise.

According to one embodiment of the invention, a contact zone between the second supporting surface of the transmission element and the first operative surface of the piston and/or between the cylindrical surface of the eccentric and the first supporting surface of the transmission element is slightly convex in a direction transversely with respect to the radii of curvature of said surfaces. This convex shape of the contact zone is also referred to as a "spherical shape". An advantage of a convex or spherical shape of the contact zones mentioned is that angle misalignments which may be present between the eccentric axis and a piston axis normal are compensated for. As a result, the forces can be easily transmitted from the eccentric to the transmission element and from the transmission element to the piston even if the eccentric axis does not run exactly at a right angle to the longitudinal axis of the piston. By means of the convex or spherical shape of the contact zones, the piston-cylinder assembly according to the invention is insensitive to manufacturing-induced deviations, or deviations arising during the course of operation, in the angle between the eccentric axis of rotation and the piston longitudinal axis from the value of 90°.

The eccentric can be a cylindrical disk connected to the drive shaft. Alternatively, the eccentric can be formed integrally and in one piece with the drive shaft.

The transmission element can basically be supported with its first supporting surface directly on the cylindrical shell surface of the eccentric. In this case, the cylindrical surface of the eccentric is the cylindrical shell surface of the eccentric itself.

According to one embodiment of the invention, it is provided that the cylindrical surface of the eccentric is a cylindrical outer shell surface of an outer ring of a rolling contact bearing, the rolling contact bearing being arranged on the eccentric. The rolling contact bodies of the rolling contact bearing can be directly in contact with the shell surface of the eccentric, or a bearing inner ring can be arranged between the rolling contact bodies and the shell surface of the eccentric. The outer shell surface of the bearing outer ring then forms the cylindrical surface of the eccentric, said cylindrical surface interacting with the first supporting surface of the transmission element. By means of the rolling contact bearing, the friction between the eccentric and the transmission element is considerably reduced in comparison to a design in which the transmission element is supported with its first supporting surface directly on the shell surface of the eccentric.

According to one embodiment of the invention, two piston guide rings are provided which are arranged spaced apart from each other in the axial direction of the eccentric, wherein two second operative surfaces are formed on the piston, with in each case one second operative surface being assigned to an inner shell surface of a piston guide ring. As a result, tilting of the piston about an axis running perpendicularly to its longitudinal axis as a result of unilateral introduction of a return force into the piston can be avoided. The return force is therefore introduced into the piston symmetrically on both sides of the piston center line. As a result, the piston cannot tilt and is guided better.

According to one embodiment of the invention, at least part of the second operative surface formed on the piston or parts of the second operative surfaces formed on the piston is or are arranged offset outward in a direction perpendicular to the center line of the piston in relation to the first operative surface of the piston interacting with the transmission element and spaced apart radially outward in the direction of the center line of the piston. In this way, the piston-cylinder assembly takes up little construction space both in the axial direction of the eccentric and in the radial direction of the eccentric and is very compact.

According to one embodiment of the invention, the transmission element is manufactured from a metal or a metal alloy with a small coefficient of sliding friction, in particular from copper, bronze or a brass alloy. By means of the small surface pressures to which the transmission element is exposed in the case of the design according to the invention, the material for the transmission element can be selected such that the sliding friction between the transmission element and the cylindrical surface of the eccentric or the first operative surface of the piston is minimized. In addition to the advantage of smaller sliding friction, favorable properties with regard to emergency operation and deficient lubrication are also achieved with the selection of material.

According to one embodiment of the invention, the first supporting surface of the transmission element and/or the first operative surface of the piston has or have a recess forming a lubricant reservoir. As a result, sufficient supply of lubricant to the contact surfaces is always ensured.

FIG. 1 shows a first embodiment of a piston-cylinder assembly according to the invention in a radial half section. The piston-cylinder assembly comprises a drive shaft 4, not illustrated specifically in FIG. 1. Only the axis of rotation 5 of the drive shaft 4 is indicated in FIG. 1. Pistons 1 are arranged distributed in the circumferential direction about the drive shaft 4. The center lines 3 of the cylinder bores 2, not illustrated in FIG. 1 for reasons of better clarity, intersect in the axis of rotation 5 of the drive shaft 4. The cylindrical eccentric 6 is designed as an integral part of the drive shaft 4 or as a component connected to the drive shaft 4 for rotation therewith. The center point 7 of the eccentric 6 is arranged offset by a distance from the axis of rotation 5 of the drive shaft 4 to produce the eccentricity. The eccentric 6 has, as the shell surface, a cylindrical surface 10 with a radius 17.

The piston-cylinder assembly according to the invention furthermore comprises a cylindrical piston guide ring 13 which has an inner shell surface 14.

A transmission element 8 is arranged between the eccentric 6 and the piston 1 of a piston-cylinder assembly. The transmission element 8 is used to transmit the stroke of the eccentric 6 to the piston 1 so that the latter executes the compression movement in the direction of the top dead center TDC. In the exemplary embodiment illustrated in FIG. 1, the transmission elements 8 are supported via a first supporting surface 9 directly on the cylindrical surface 10 of the eccentric 6. In the exemplary embodiment illustrated in FIG. 1, the first supporting surface 9 is designed as a concavely arched cylinder shell section surface with a first supporting surface radius 16. The first supporting surface radius 16 corresponds here to the radius 17 of the cylindrical surface 10. The first supporting surface 9 and the cylindrical surface 10 are therefore complementary to each other. In principle, the first supporting surface 9 could also have a concave shape differing from the circular ring shape.

The transmission element 8 has a convexly shaped second supporting surface 12. In the exemplary embodiment illustrated in FIG. 1, the second supporting surface 12 is designed as a cylinder shell section surface with a second supporting surface radius 19. In principle, instead of a cylinder shell section shape, the second supporting surface 12 could also have a convex shape differing from the cylindrical shape. The piston 1 is supported on the second supporting surface 12 of the transmission element 8 via a first operative surface 11 formed on the piston 1. The first operative surface 11 of the piston 1 is shaped concavely. In the exemplary embodiment illustrated, the first operative surface 11 of the piston 1 is designed as a concave cylinder shell section surface with a first operative surface radius 22 which corresponds to the second supporting surface radius 19. The first operative surface 11 of the piston 1 and the second supporting surface 12 of the transmission element 8 are therefore formed in a complementary manner to each other. In principle, the first operative surface 11 of the piston 1 could also have a concave shape differing from the cylindrical shape.

A convexly shaped, second operative surface 15 is formed on the piston 1. In the exemplary embodiment illustrated, the second operative surface 15 of the piston 1 is a cylinder shell section surface with a second operative surface radius 20. The piston is in form-fitting engagement with the inner shell surface 14 of the piston guide ring 13 via the second operative surface 15. The form fit is effective in the direction of the center line 3 of the cylinder bore 2. By means of the piston guide ring 13, the return movement is transmitted to the second operative surface 15 of the piston 1, i.e. the movement with which the piston 1 is moved from the top dead center TDC into the bottom dead center BDC of the piston movement.

In the exemplary embodiment illustrated in FIG. 1, the second supporting surface radius 19 of the transmission element 8 and the second operative surface radius 22 of the piston 1 have the same center point 21. The center point 21 corresponds here to that point at which the center line 3 of the cylinder bore 2 penetrates the cylindrical surface 10 of the eccentric 6. The effect achieved by this design measure is that the sum of the radius 17 of the cylindrical surface 10 and the second operative surface radius 22 of the piston 1 corresponds to the radius 23 of the inner shell surface 14 of the piston guide ring 13. The effect achieved by this is that the piston guide ring 13, with its inner shell surface 14, never, i.e. not in any angular position of the eccentric 6 or of the drive shaft 4, loses contact with the second operative surface 15 of the piston 1. The piston guide ring 13 is thereby always in contact (without losing contact) with the respective piston 1. Additional contact changes and sliding displacement movements between the piston guide ring 13 and piston 1 are therefore avoided, and this has dynamic advantages in respect of the kinematics of the movement sequence and advantages in terms of wear. Acoustic advantages are thereby also achieved because no rattling noises or other annoying noises arise.

The piston guide ring 13 guides the pistons 1 on the eccentric 6 (or on the bearing outer ring 25, cf. exemplary embodiments two, three and four below) and prevents the pistons 1 from "lifting off" from the cylindrical surface 10 (or from the outer shell surface 24 of the outer ring 25 of the rolling contact bearing 26) during a downward movement/return movement of the pistons 1. The piston guide ring 13 slides on the second operative surface 15, which is formed on the piston 1. The piston guide ring 13 keeps the pistons 1 and the transmission elements 8 in sliding contact with the eccentric 6 (or with a bearing outer ring 25 of a rolling contact bearing 26 arranged on the eccentric, according to the embodiments of the invention that are described below).

Figure 2:
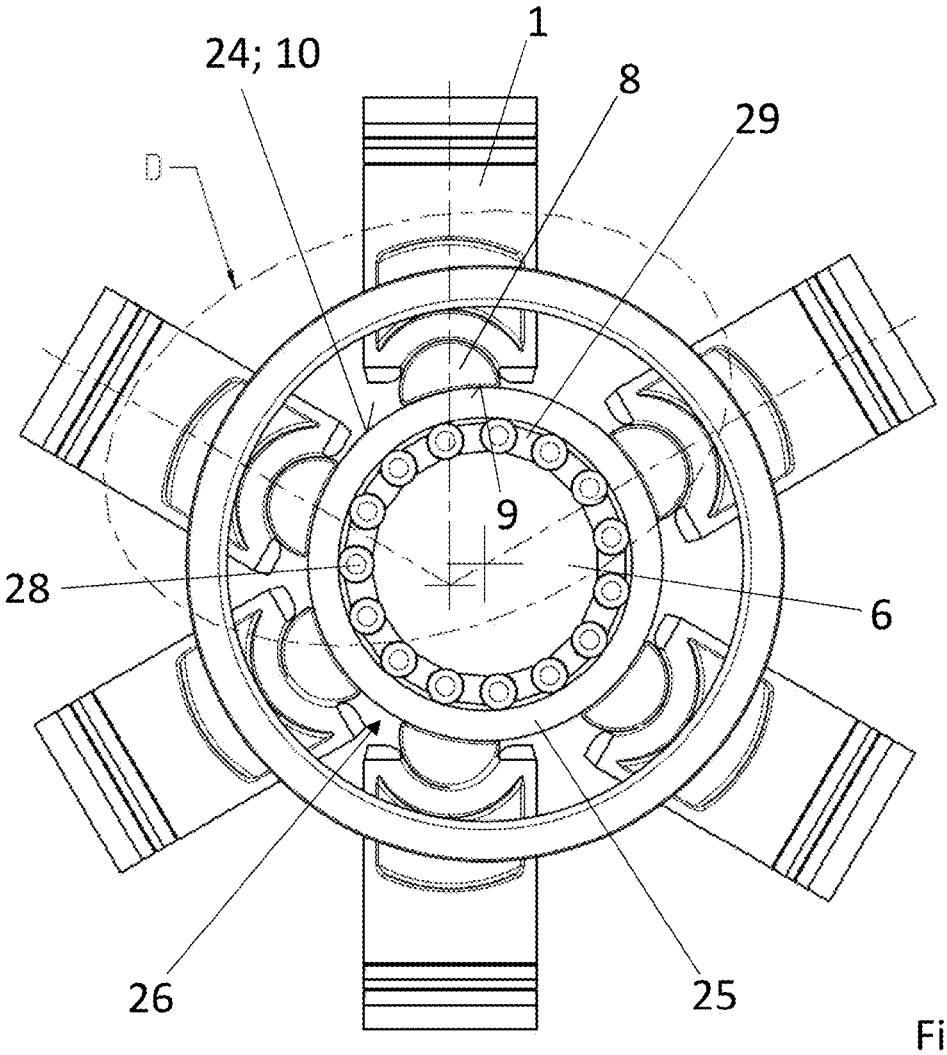
FIG. 2 is a radial half sectional view of a second embodiment of a piston-cylinder assembly according to the invention.

FIG. 2 shows a second embodiment of a piston-cylinder assembly according to the invention in a radial half section. This second embodiment differs from the first embodiment illustrated in FIG. 1 in that a rolling contact bearing 26 is arranged on the eccentric 6 by means of an outer ring 25 and rolling contact bodies 28. The transmission elements 8 are not supported, as in the first embodiment, directly on the shell surface of the eccentric 6, but rather are supported on the outer shell surface 24 of the bearing outer ring 25. In the second embodiment of the invention, the cylinder shell surface 10 of the eccentric is therefore formed by the outer shell surface 24 of the bearing outer ring 25 of the rolling contact bearing 26. Otherwise, the description of the first exemplary embodiment also applies to the second exemplary embodiment.

The rolling contact bearing 26 is arranged on the eccentric 6. In more precise terms, in the exemplary embodiment illustrated, the rolling contact bodies 28 of the rolling contact bearing 26 roll directly on the shell surface of the eccentric 6. In principle, it would also be possible for a bearing inner ring to be provided on which the rolling contact bodies 28 roll. In the exemplary embodiment illustrated, the rolling contact bodies 28 are held by a cage 29 or are guided by the latter. The rolling contact bearing 26 can be designed, for example, as a needle bearing or as a cylindrical roller bearing.

A number of advantages are obtained by the use of the rolling contact bearing 26. Firstly, the friction is significantly reduced in comparison to the first embodiment of the invention. Secondly, the outer shell surface 24 of the bearing outer ring 25 can be hardened more simply than the shell surface of the eccentric 6. This is true in particular if the eccentric 6 is formed integrally in one piece with the drive shaft 4 (not illustrated in FIG. 2). It may be advantageous to harden the surface on which the transmission elements 8 are supported by their first supporting surface 9. In particular in the case of radial piston compressors for the refrigerant $CO_2$, the hardening of the surface, with which the transmission elements 8 are in contact via their first supporting surface, may be required in order to avoid premature wear due to the high forces and surface pressures which occur. It is then simpler to harden a separate outer ring of the rolling contact bearing 26 as an individual component than to harden the shell surface of an eccentric 6 formed integrally and in one piece with the drive shaft 4.

Figure 3:
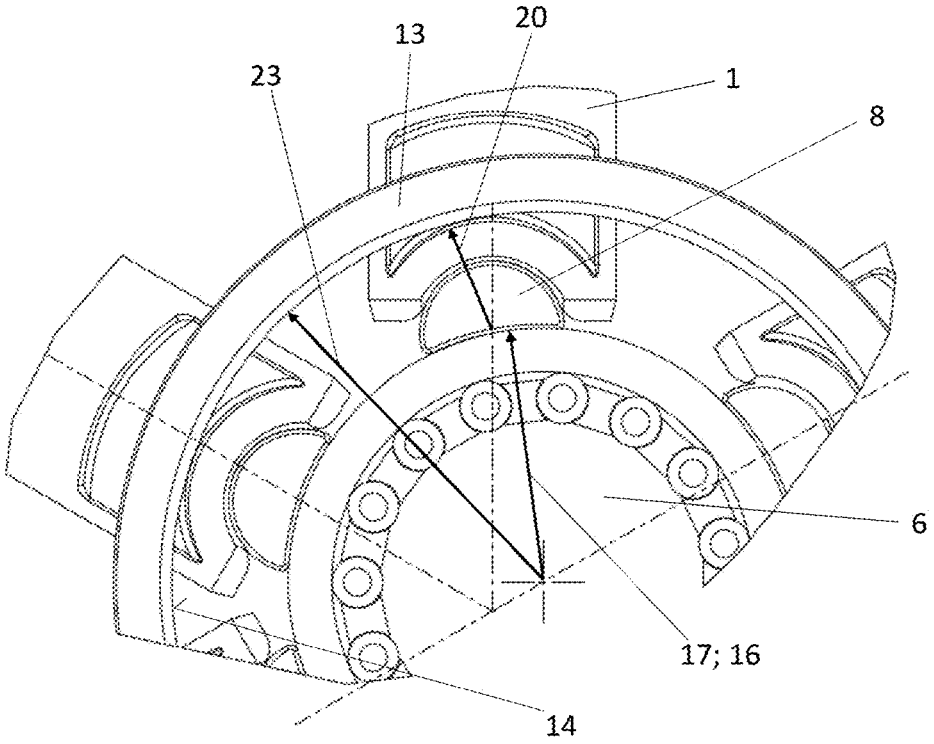
FIG. 3 is an enlarged illustration of the region D from FIG. 2.

FIG. 3 shows an enlarged illustration of the region D of the second exemplary embodiment from FIG. 2. The radius 23 of the inner shell surface 14 of the piston guide ring 13 and the radius 17 of the cylindrical surface 10 are shown, the cylindrical surface 10 being formed by the outer shell surface 24 of the outer ring 25 of the rolling contact bearing 26. Furthermore, the first supporting surface radius 16 and the second operative surface radius 20 are shown.

Figure 4:
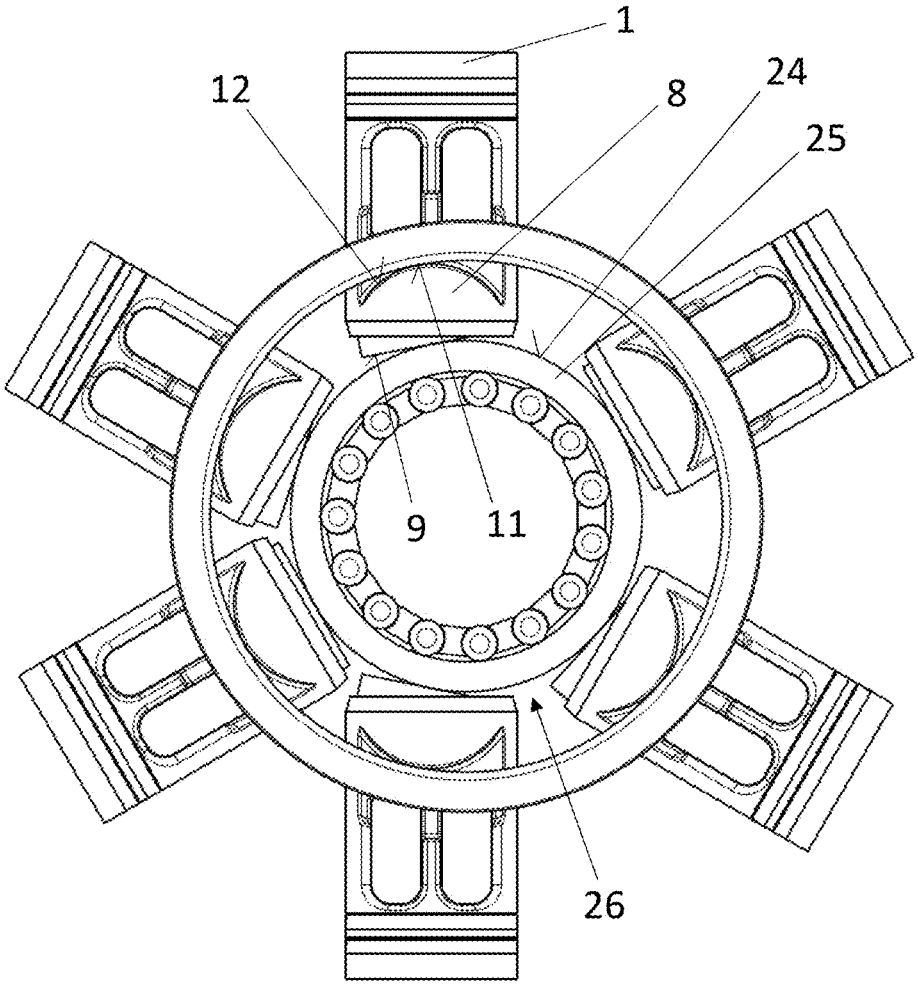
FIG. 4 is a radial half sectional view of a third embodiment of a piston-cylinder assembly according to the invention.

FIG. 4 shows a third embodiment of a piston-cylinder assembly according to the invention in a radial half section. This third embodiment substantially corresponds to the second embodiment of the invention, the sole difference consisting in the design of the transmission element 8. In the case of the third embodiment of the invention according to FIG. 4, the first supporting surface 9 is designed as a flat circular surface or surface in the shape of a circular disk, not as a concavely arched surface as in the case of the second exemplary embodiment. It can be seen at the individual contact points between the flat supporting surfaces 9 and the outer shell surface 24 of the bearing outer ring 25 that the transmission element 8 tilts relative to the piston 1 as a result of the movement of the eccentric 6. The transmission element 8 slides with its convexly shaped, second supporting surface 12 in relation to the concavely shaped, first operative surface 11 of the piston 1. The transmission element 8 also slides with its flat first supporting surface 9 relative to the outer shell surface 24 of the outer ring 25 of the rolling contact bearing 26.

Figure 5:
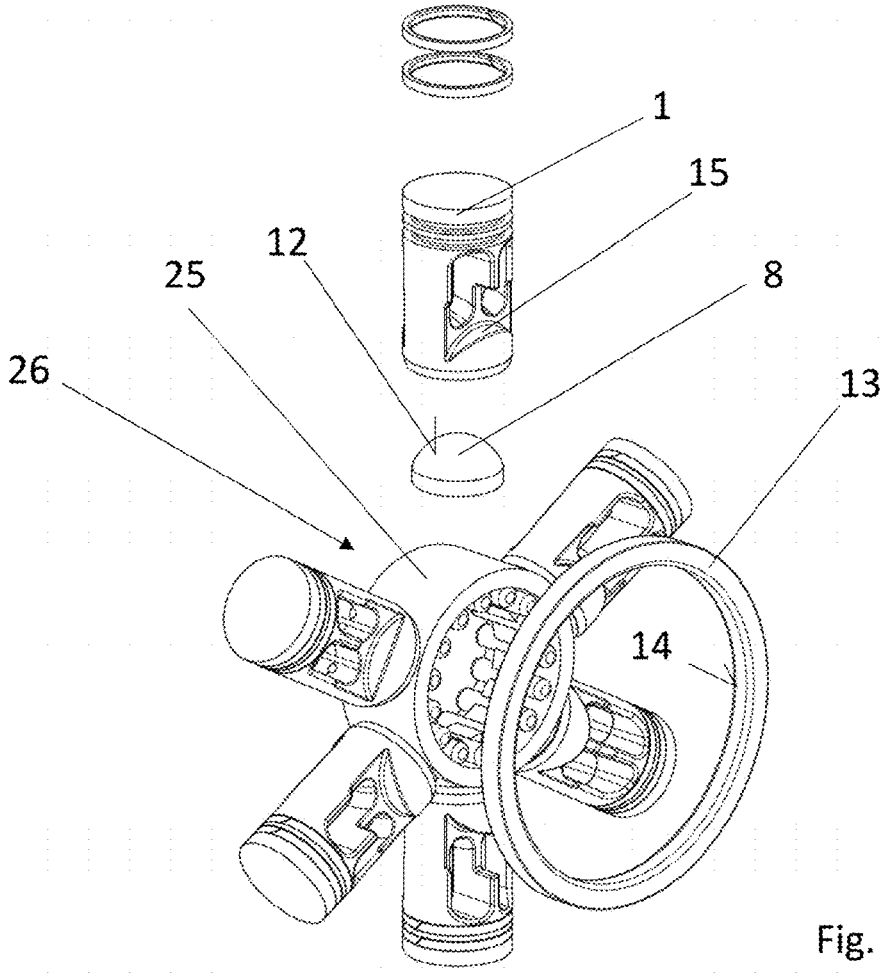
FIG. 5 is an enlarged view of a fourth embodiment of the piston-cylinder assembly according to the invention.

FIG. 5 shows a fourth embodiment of the piston-cylinder assembly according to the invention in an exploded illustration. Precisely as in the case of the second and third embodiment, the transmission elements 8 are supported on the outer ring 25 of the rolling contact bearing 26. The eccentric 6 is not illustrated in FIG. 5. The second operative surface 15 of the piston 1 is also formed in precisely the same manner and interacts with the inner shell surface 14 of the piston guide ring 13 in precisely the same manner as in the case of the first to third embodiments. The difference of the fourth embodiment according to FIG. 4 resides in the design of the transmission element 8 which has a convex, spherical-cup-shaped second supporting surface 12 and a flat first supporting surface 9, and in the design of the piston 1 which has a concave first operative surface 11 (concealed in FIG. 4) which is in the shape of a ball socket and which interacts with the second supporting surface 12.

The basic functioning corresponds to that of the first to third embodiments of the invention. The spherical-cap shape of the second supporting surface 12 of the transmission element 8 and the ball socket shape of the first operative surface 11 of the piston 1 affords additional advantages:

- The transmission element 8 is accommodated in a manner secured axially in the ball socket of the piston 1. An additional axial securing, in order to prevent the transmission element 8 from migrating axially (and which is required in the case of the transmission element 8 with the cylindrical shell section of the second supporting surface 12) can be dispensed with in the case of the second supporting surface 12, designed as a spherical cap, and the first operative surface 11, designed as a ball socket.
- An oblique position of the drive shaft 4 (not illustrated in FIG. 4) with respect to the center lines 3 of the cylinder bores 2 (not illustrated in FIG. 4) can be compensated for by the pairing of ball socket and spherical segment according to the fourth exemplary embodiment.
- If, as illustrated in FIG. 5, only a single piston guide ring 13 is provided, the guide length between the piston 1 and cylinder bore 2 on the opposite side of the piston guide ring 13 can then be realized as far as the piston foot. If the piston length is the same, better guidance of the piston 1 is thereby achieved.

Figure 6:
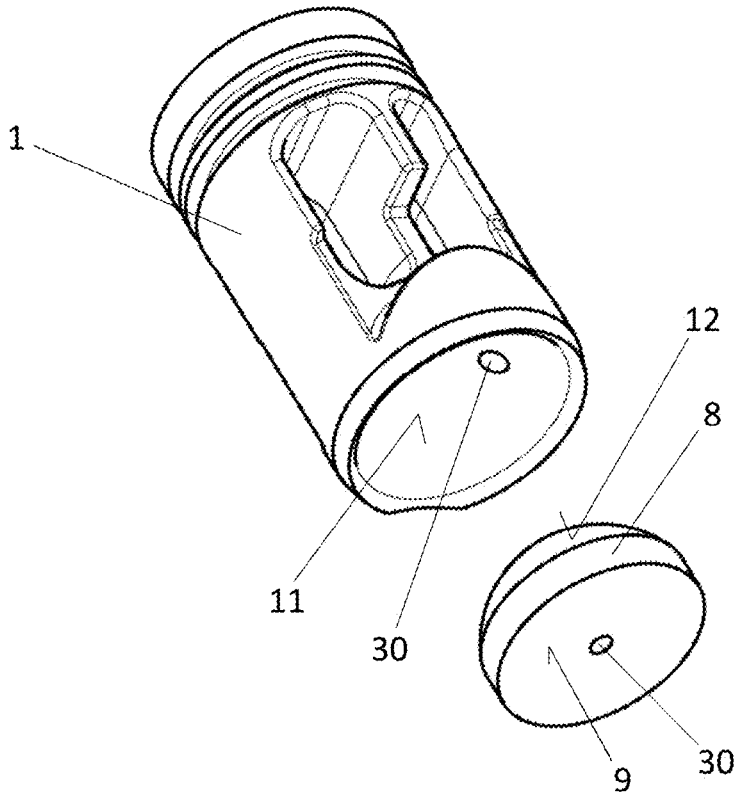
FIG. 6 is a perspective view of the piston and the transmission element as individual parts.

FIG. 6 illustrates the piston 1 and the transmission element 8 according to the fourth embodiment of the invention as individual components. The concave, spherical-cap-shaped first operative surface 11 of the piston 1 forms a ball socket (or spherical hollow) in which the convex, spherical-cap-shaped second supporting surface 12 of the transmission element 8 is accommodated in the assembled state of the piston-cylinder assembly.

The underside of the transmission element 8 facing the eccentric 6 (not illustrated in FIG. 6) is plane, i.e. the first supporting surface 9 is a flat surface. The effect achieved by the flat first supporting surface 9 is that the transmission element 8 can rotate freely in the circumferential direction relative to the piston 1. By means of the linear contact with the outer shell surface 24 of the bearing outer ring 25 (not illustrated in FIG. 6), the surface pressures on the transmission element 8 are indeed higher than in the case of a transmission element 8 that is designed in accordance with the second embodiment of the invention. However, if the transmission element 8 is, for example, formed from rolling contact bearing steel and hardened (e.g. 100Cr6 hardened), it can withstand the increased surface pressures.

In the exemplary embodiment illustrated, the first supporting surface 9 of the transmission element 8 and the first operative surface 11 of the piston 1 have a recess 30 forming a lubricant reservoir. Lubricant (e.g. lubricating oil) collects in the recesses 30. Said lubricant reservoirs ensure that lubricant is always present in a sufficient quantity in the contact surfaces.

Figure 7:
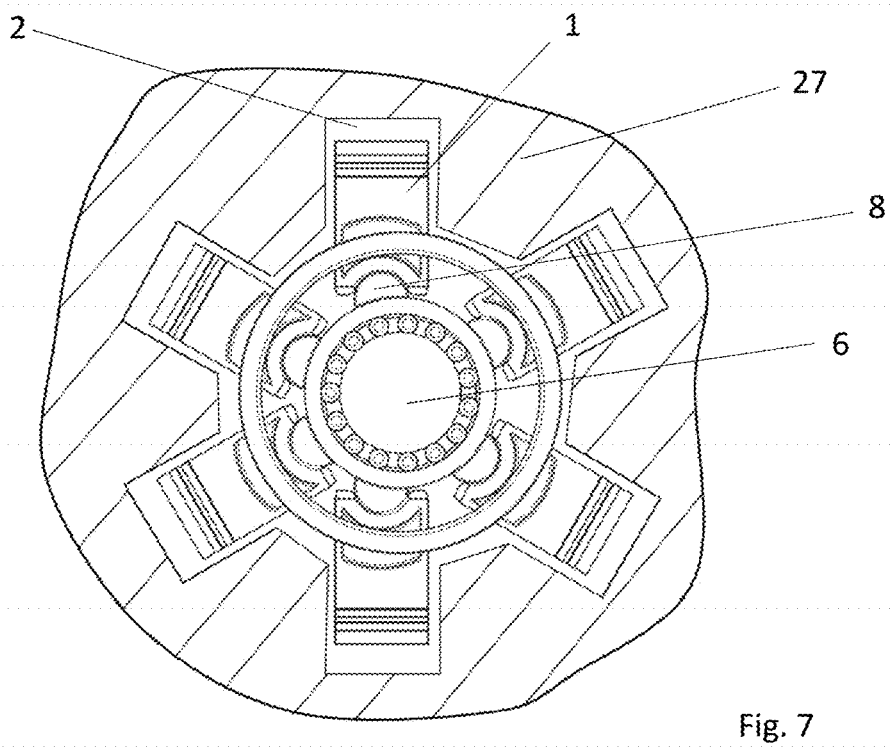
FIG. 7 is a radial piston compressor with piston-cylinder assemblies according to the invention.

FIG. 7 schematically shows a radial piston compressor with piston-cylinder assemblies according to the invention. In the exemplary embodiment illustrated, the piston-cylinder assemblies are designed by way of example in accordance with the second embodiment of the invention, i.e. the transmission elements 8 have cylinder-section-shaped, concave first supporting surfaces 9 and the second supporting surfaces 12 of the transmission elements 8 are in the shape of cylinder sections and interact with cylinder-section-shaped first operative surfaces 11 of the pistons 1. It goes without saying that the piston-cylinder assemblies could also be designed in accordance with the first, third or fourth embodiment of the invention.

The cylinder bores 2 are arranged in a cylinder block 27. The individual pistons 1 are driven by an eccentric 6 via a single drive shaft 4. To achieve better clarity, none of the details that a complete radial piston compressor has have been illustrated in FIG. 7. For example, all of the valve arrangements and inflow and outflow channels for the refrigerant are omitted. Owing to the piston-cylinder assemblies according to the invention, the radial piston compressor according to FIG. 7 is small in the radial direction and also in the axial direction, i.e. it takes up little construction space in both directions mentioned.

Figure 8:
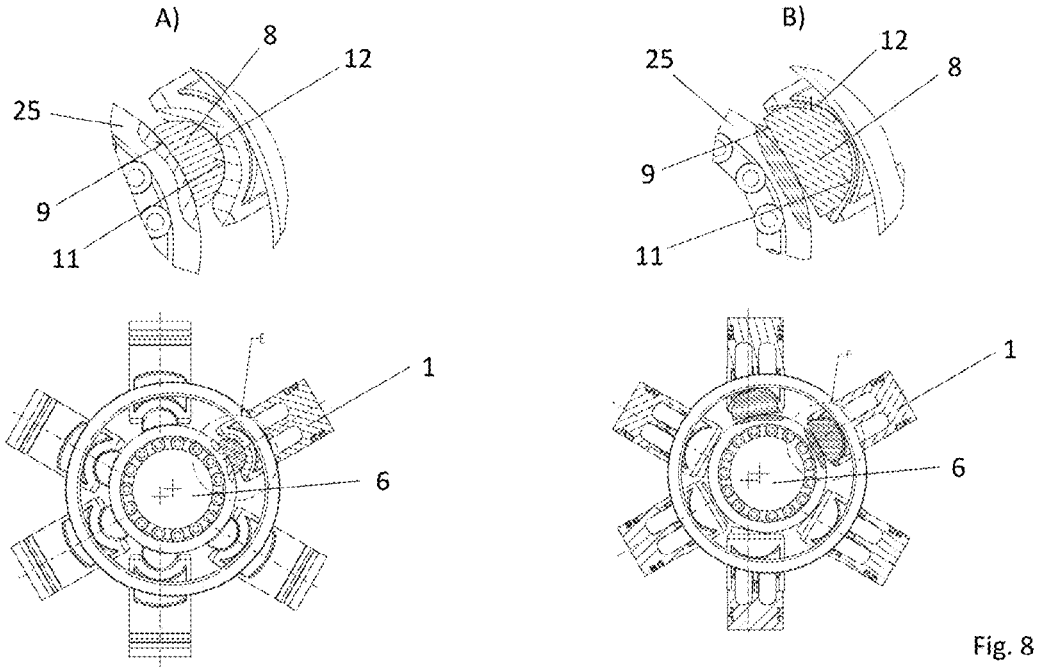
FIG. 8 is a comparative juxtaposition of the second and the fourth embodiment of the invention.

FIG. 8 illustrates the differences between the second and the fourth embodiment of the invention once again in a comparative juxtaposition. The illustration for A) on the left-hand side shows the second embodiment of the invention. The transmission element 8 has a first supporting surface 9 designed as a concave cylinder shell section surface and a second supporting surface 12 designed as a convex cylinder shell section surface. Accordingly, the first operative surface 11 of the piston 1 is designed as a concave cylinder shell section surface. The fourth embodiment of the invention is illustrated on the right-hand side at B). The transmission element 8 has a flat first supporting surface 9 and a second supporting surface 12 designed as a spherical surface section or spherical surface segment. The first operative surface 11 of the piston 1 is accordingly designed as a ball socket.

If, in the present patent claims or in the present description, the discussion with regard to surfaces or radii is that one surface corresponds to another, that one surface is complementary to another surface, or that one radius corresponds to another radius, this does not inevitably mean that the surfaces or radii have to be formed exactly identically. In order to obtain a good contact surface and to avoid what are referred to as "edge supports" occurring (i.e. arrangements in which only partial regions of the contact surfaces bear the loads), the second supporting surface radius 19, for example, is always intended to be somewhat smaller than the first operative surface radius 22 on the piston 1. For the same reason, the first supporting surface radius 9, for example, on the transmission element 8 is always intended to be somewhat larger than the radius 17 of the cylindrical surface 10 or the radius of the outer shell surface 24 of the outer ring 25 of the rolling contact bearing 26.

LIST OF REFERENCE SIGNS

1 Piston
2 Cylinder bore
3 Center line of the cylinder bore
4 Drive shaft
5 Axis of rotation of the drive shaft
6 Eccentric
7 Center point of the eccentric
8 Transmission element
9 First supporting surface of the transmission element
10 Cylindrical surface
11 First operative surface of the piston
12 Second supporting surface of the transmission element
13 Piston guide ring
14 Inner shell surface of the piston guide ring
15 Second operative surface of the piston
16 First supporting surface radius
17 Radius of the cylindrical surface
19 Second supporting surface radius
20 Second operative surface radius
21 Center point
22 First operative surface radius
23 Radius of the inner shell surface of the piston guide ring
24 Outer shell surface
25 Outer ring
26 Rolling contact bearing
27 Cylinder block
28 Rolling contact body
29 Cage
30 Recess

The invention claimed is:

1. A piston-cylinder assembly for a radial piston compressor, comprising:

a piston;

a cylinder bore, in which the piston is arranged displaceably along a center line of the cylinder bore;

a drive shaft with an axis of rotation and with a cylindrical eccentric, the center point of which is spaced apart from the axis of rotation of the drive shaft, wherein, during a rotational movement of the drive shaft, the piston is movable by the cylindrical eccentric in the cylinder bore in a manner directed outward in the radial direction away from the drive shaft as far as a top dead center; and a transmission element, which transmits the movement of the eccentric to the piston for generating the movement of the piston outward in the cylinder bore in a manner directed away from the drive shaft, wherein the transmission element has a first supporting surface with which the transmission element is supported on a cylinder surface of the eccentric; and a rolling contact bearing, the rolling contact bearing being arranged on the eccentric, the rolling contact bearing including an outer ring having a cylindrical outer shell surface, wherein the first supporting surface of the transmission element is supported on the cylinder surface of the eccentric by the rolling contact bearing;

wherein the piston has a concavely shaped, first operative surface facing the transmission element, and the transmission element has a convexly shaped, second supporting surface facing the first operative surface, wherein the first operative surface and the second supporting surface form a form-fitting connection which is effective in the circumferential direction of the eccentric, and wherein a cylindrical piston guide ring is provided, through which the piston is movable in the cylinder bore in a manner directed inward toward the drive shaft in the radial direction from the top dead center (TDC) as far as a bottom dead center (BDC), wherein the piston has a convexly shaped, second operative surface which faces an inner shell surface of the piston guide ring and which, together with the inner shell surface of the piston guide ring, forms a form-fitting connection which is effective in the direction of the center line of the cylinder bore.

2. The piston-cylinder assembly as claimed in claim 1, wherein the first supporting surface of the transmission element is one of a flat surface and a concavely shaped cylinder shell section with a first supporting surface radius, the first supporting surface radius corresponding to the radius of the cylindrical surface of the eccentric.

3. The piston-cylinder assembly as claimed in claim 2, wherein the second supporting surface of the transmission element and the first operative surface of the piston are cylinder shell sections with a second supporting surface radius, or wherein the second supporting surface of the transmission element is a spherical surface section and the first operative surface of the piston is a ball socket with a second supporting surface radius.

4. The piston-cylinder assembly as claimed in claim 1, wherein a contact zone between the second supporting surface of the transmission element and the first operative surface of the piston and/or between the cylindrical surface of the eccentric and the first supporting surface of the transmission element is slightly convex in a direction transversely with respect to the radii of curvature of said surfaces.

5. The piston-cylinder assembly as claimed in claim 1, wherein at least part of the second operative surface formed on the piston or parts of the second operative surface formed on the piston is or are arranged offset outward in a direction perpendicular to the center line of the piston in relation to the first operative surface of the piston interacting with the transmission element and spaced apart radially outward in the direction of the center line of the piston.

6. The piston-cylinder assembly as claimed in claim 1, wherein at least one of the first supporting surface of the transmission element and the first operative surface of the piston has a recess forming a lubricant reservoir.

7. A radial piston compressor with a plurality of piston-cylinder assemblies, which are arranged distributed uniformly in a circumferential direction, as claimed in claim 1, wherein the cylinder bores are provided in a cylinder block and the individual pistons are driven by the eccentric via the drive shaft.

8. The radial piston compressor as claimed in claim 7, wherein each individual piston engages with the eccentric via a respective independent transmission element.

9. The piston-cylinder assembly as claimed in claim 1, wherein the transmission element is manufactured from copper, bronze or a brass alloy.

* * * * *